US011320098B2

(12) United States Patent
Li et al.

(10) Patent No.: US 11,320,098 B2
(45) Date of Patent: May 3, 2022

(54) LED TUBE LIGHT WITH COLOR ADJUSTMENT SWITCH

(71) Applicant: ZHEJIANG YANKON MEGA LIGHTING CO., LTD., Zhejiang (CN)

(72) Inventors: Yang Li, Zhejiang (CN); Huanliang Wang, Zhejiang (CN); Xuan Zhao, Zhejiang (CN); Bin Yu, Zhejiang (CN); Huansheng Chen, Zhejiang (CN)

(73) Assignee: ZHEJIANG YANKON MEGA LIGHTING CO., LTD., Zhejiang (CN)

( * ) Notice: Subject to any disclaimer, the term of this patent is extended or adjusted under 35 U.S.C. 154(b) by 154 days.

(21) Appl. No.: 16/652,414

(22) PCT Filed: Feb. 24, 2020

(86) PCT No.: PCT/CN2020/076332
§ 371 (c)(1),
(2) Date: Mar. 30, 2020

(87) PCT Pub. No.: WO2021/147132
PCT Pub. Date: Jul. 29, 2021

(65) Prior Publication Data

US 2021/0404608 A1 Dec. 30, 2021

(30) Foreign Application Priority Data

Jan. 20, 2020 (CN) ..... 202020133830.2

(51) Int. Cl.
*F21K 9/278* (2016.01)
*H05B 45/24* (2020.01)
(Continued)

(52) U.S. Cl.
CPC ..... *F21K 9/278* (2016.08); *F21V 17/164* (2013.01); *F21V 23/002* (2013.01); *F21V 23/04* (2013.01); *H05B 45/24* (2020.01); *F21Y 2115/10* (2016.08)

(58) Field of Classification Search
CPC . F21K 9/278; F21K 9/27; F21K 9/275; H05B 45/24; H05B 45/20; F21V 17/164;
(Continued)

(56) References Cited

U.S. PATENT DOCUMENTS 8,523,394 B2 * 9/2013 Simon ..... F21V 25/04 362/249.05
10,197,224 B1 * 2/2019 Macias ..... F21V 7/005
2012/0274774 A1 * 11/2012 Bushee ..... G11B 33/025 348/158

FOREIGN PATENT DOCUMENTS

CN 208579182 U 3/2019

OTHER PUBLICATIONS

International Search Report and the Written Opinion of the International Search Authority for PCT application No. PCT/CN2020/076332.

* cited by examiner

*Primary Examiner* — Bao Q Truong
(74) *Attorney, Agent, or Firm* — Yue (Robert) Xu; Apex Attorneys at Law, LLP

(57) ABSTRACT

An LED tube light with a color adjustment switch related to the technical field of home appliances includes an LED tube light body. The LED tube light body is provided with a tube light body and terminals located at two ends of the tube light body and used for connecting with a mounting seat. The tube light body includes a light tube, an LED light strip with at least two different color temperatures, and a driving power source electrically connected with the LED light strip. The
(Continued)

LED tube light body further includes at least one color adjustment switch fixed on the respective terminal. The color adjustment switch is configured to control the on and off of different color temperatures of the LED light strip.

9 Claims, 8 Drawing Sheets

(51) Int. Cl.

| | |
|---|---|
| ***F21V 17/16*** | (2006.01) |
| ***F21V 23/00*** | (2015.01) |
| ***F21V 23/04*** | (2006.01) |
| *F21Y 115/10* | (2016.01) |

(58) Field of Classification Search
CPC .... F21V 23/002; F21V 23/04; F21V 23/0421; F21V 23/003; F21V 23/004; F21V 23/00; F21V 23/006; F21Y 2115/10
See application file for complete search history.

LED TUBE LIGHT WITH COLOR ADJUSTMENT SWITCH

This application is the national phase of International Application No. PCT/CN2020/076332, titled "LED TUBE LIGHT WITH COLOR ADJUSTMENT SWITCH", filed on Feb. 24, 2020, which claims the priority to Chinese Patent Application No. 202020133830.2, titled "LED TUBE LIGHT WITH COLOR ADJUSTMENT SWITCH", filed with China National Intellectual Property Administration, on Jan. 20, 2020, the entire disclosures thereof are incorporated herein by reference.

FIELD

The present application relates to the technical field of home appliances, and in particular to an LED tube light with a color adjustment switch.

BACKGROUND

An LED tube light is a kind of lighting product using LED as the light source. Compared with fluorescent tube light, the LED tube light has the advantages of energy saving, low price, long service life and simple structure. Therefore, LED tube lights are widely used in homes, shopping malls, classrooms and other places.

The existing LED tube lights usually can only emit light with one color temperature, and the color is relatively monotonous. In order to achieve adjustment of multiple color temperatures, LED tube lights with different color temperatures have appeared on the market, and the color-temperature adjustment of the LED tube lights is controlled by a wall switch. For example, the Chinese patent No. CN 202629690 U discloses a color-temperature adjustable tube light. The color-temperature adjustable tube light includes a sleeve, two contact-needle tube-foot sleeves, an LED color-temperature control module, and a fluorescent tube with a high or low color temperature. The LED color-temperature control module and the fluorescent tube are both arranged in the sleeve, the two contact-needle tube-foot sleeves are respectively sleeved on two ends of the sleeve, two ends of the fluorescent tube are respectively connected to corresponding control circuit modules of the LED color-temperature control module, and the LED color-temperature control module is provided with a remote controller or an alternating current power switch.

The color-temperature adjustable tube light utilizes fluorescent tubes and LED light source modules which are matched with each other to achieve different color temperature lighting effects, however, when the LED color-temperature control module is controlled by the alternating current power switch, if the lighting area of the LED tube light is far from the switch, the difficulty of operating the color-temperature adjustable tube light will rise; and when the LED color-temperature control module is controlled by the remote controller, it is necessary to limit the area where the remote controller is placed, otherwise the difficulty of operating the color-temperature adjustable tube light will rise. Besides, when replacing the original fluorescent tube light with an LED tube light, the switch needs to be modified, which results in an increase in cost. The color-temperature adjustable tube light needs to be improved.

SUMMARY

In view of this, an object of the present application is to provide an LED tube light with a color adjustment switch, to realize easy operation. The technical solution is as follows.

An LED tube light with a color adjustment switch includes an LED tube light body. The LED tube light body is provided with a tube light body and terminals located at two ends of the tube light body and used for connecting with a mounting seat. The tube light body includes a light tube, an LED light strip with at least two different color temperatures, and a driving power source electrically connected with the LED light strip. The LED tube light body further includes at least one color adjustment switch fixed on the respective terminal. The color adjustment switch is configured to control the on and off of different color temperatures of the LED light strip.

Preferably, the LED light strip includes LED lamp beads with at least two different color temperatures, and an aluminum-based circuit board or a flexible light board for connecting and fixing the LED lamp beads.

Preferably, the LED light strip includes 2700K lamp beads and 6500K lamp beads.

Preferably, the color adjustment switch includes a shift switch fixed on the driving power source, a switch panel for driving the shift switch is provided on the terminal, and connection wires electrically connected with the LED light strip are provided at one end of the driving power source.

Preferably, the terminal is provided with a groove-shaped installation hole, and a lower end of the switch panel is inserted into the installation hole and connected to the shift switch, and buckle feet abutting an inner side wall of the terminal are provided on two sides of the switch panel along a width direction of the installation hole.

Preferably, a cross section of the switch panel along the width direction of the installation hole is in the shape of $\pi$.

Preferably, multiple parallel ribs are arranged on an upper side of the switch panel.

Preferably, the light tube is a glass light tube or a plastic light tube.

Preferably, the light tube is a T8 light tube or a T5 light tube.

Preferably, the driving power source is a switching power source, or a linear power source.

It is conceivable from the above solutions that the LED tube light with a color adjustment switch according to the present application has the following advantages:

1. The on and off of different color temperatures of the LED light strip is controlled by the shift switch, and when the LED light strip has two different color temperatures, three or more color-temperature modes can be obtained by turning on the two color temperatures separately or simultaneously.

2. Through the modification of the LED tube light body, the modification for the mounting seat or the switch controlling the mounting seat can be omitted, thereby saving time and efforts.

3. The structure is simple and easy to manufacture, and the present application thereby has good economic benefits.

DETAILED DESCRIPTION OF THE DRAWINGS

In order to illustrate technical solutions in embodiments of the present application or the conventional technology more clearly, drawings to be used in the description of the embodiments or the conventional technology are briefly described below. Apparently, the drawings described below only illustrate some embodiments of the present application, and other drawings may be obtained by those skilled in the art according to the provided drawings without any creative work.

Figure 1:
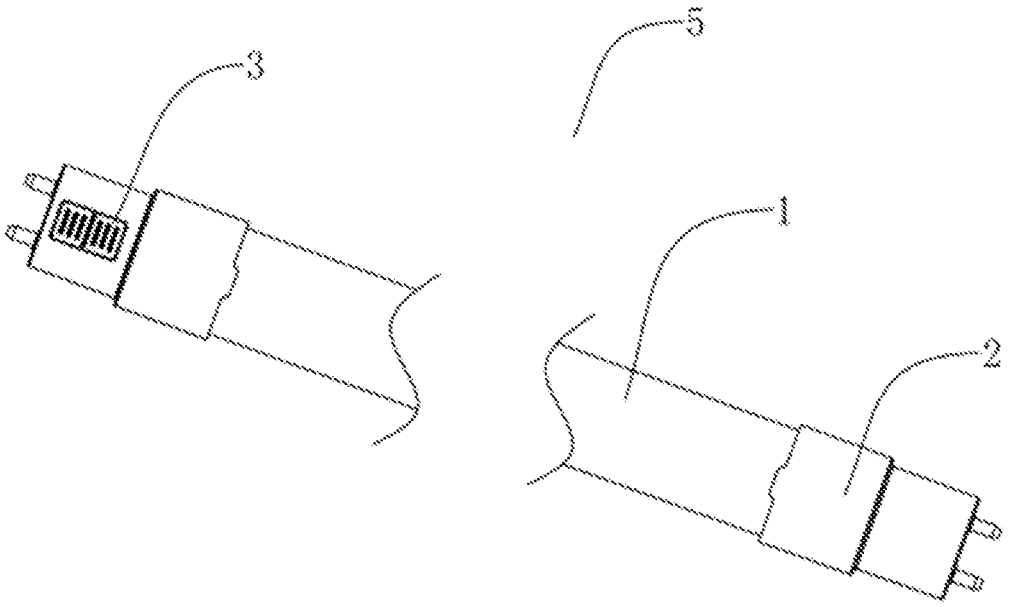
FIG. 1 is a schematic structural view of an LED tube light body according to the present application.

| Reference numerals are listed as follows: | |
|---|---|
| 1 tube light body; | 2 terminal; |
| 21 installation hole; | 3 color adjustment switch; |
| 31 driving power source; | 32 shift switch; |
| 33 switch panel; | 331 buckle foot; |
| 332 fixing member; | 34 connection wire; |
| 4 LED light strip; | 5 LED tube light body; |
| 6 mounting seat. | |

DETAILED DESCRIPTION OF THE EMBODIMENTS

The technical solutions according to the embodiments of the present application will be described clearly and completely as follows in conjunction with the drawings in the embodiments of the present application. It is apparent that the described embodiments are only a part rather than all of the embodiments according to the present application. Any other embodiments obtained by those skilled in the art based on the embodiments in the present application without any creative efforts fall within the scope of protection of the present application.

First Embodiment

Figure 6:
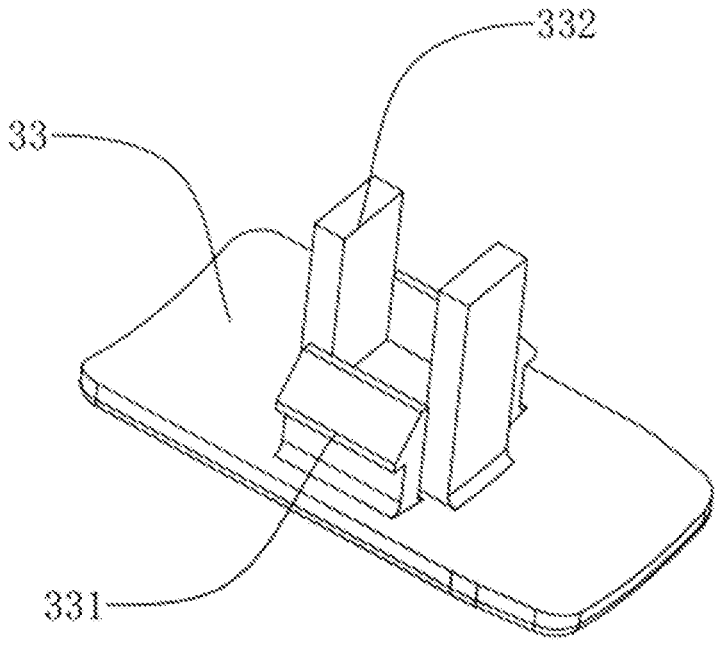
FIG. 6 is a schematic view showing a first structure of a switch panel according to the present application.

As shown in FIGS. 1 and 6, an LED tube light with a color adjustment switch includes an LED tube light body 5. The LED tube light body 5 is provided with a tube light body 1 and terminals 2 arranged at two ends of the tube light body 1. The terminals 2 are configured to match with a mounting seat 6 and to be fixed to the mounting seat 6. The mounting seat 6 provides power to the LED tube light body 5 while fixing the terminals 2, and is matched with a corresponding switch to realize the on and off of the LED tube light body 5.

Figure 2:
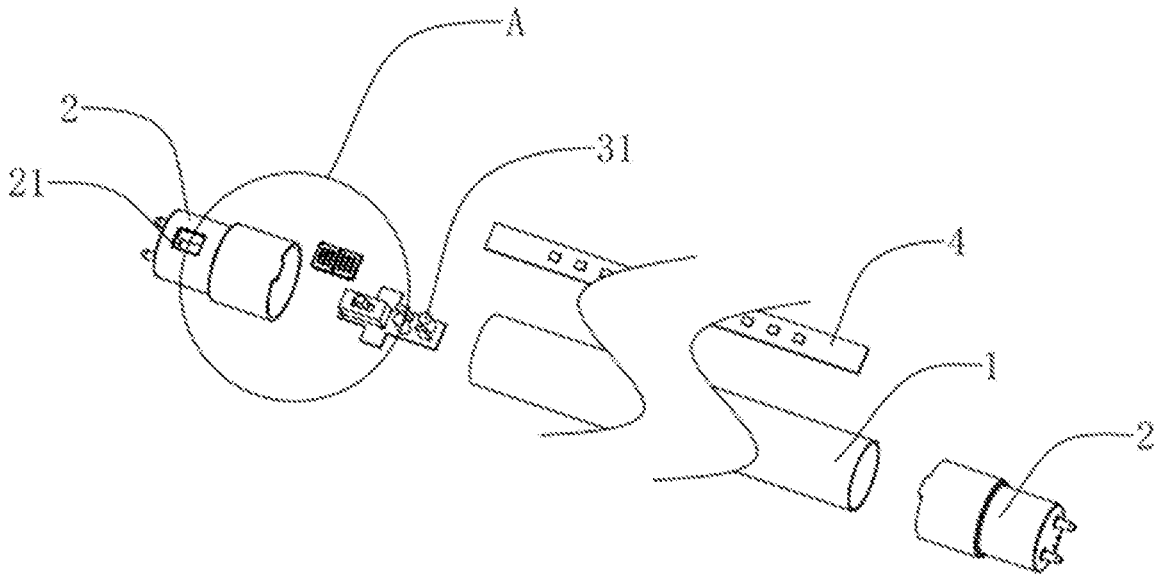
FIG. 2 is a schematic exploded view of the LED tube light body according to the present application.
Figure 3:
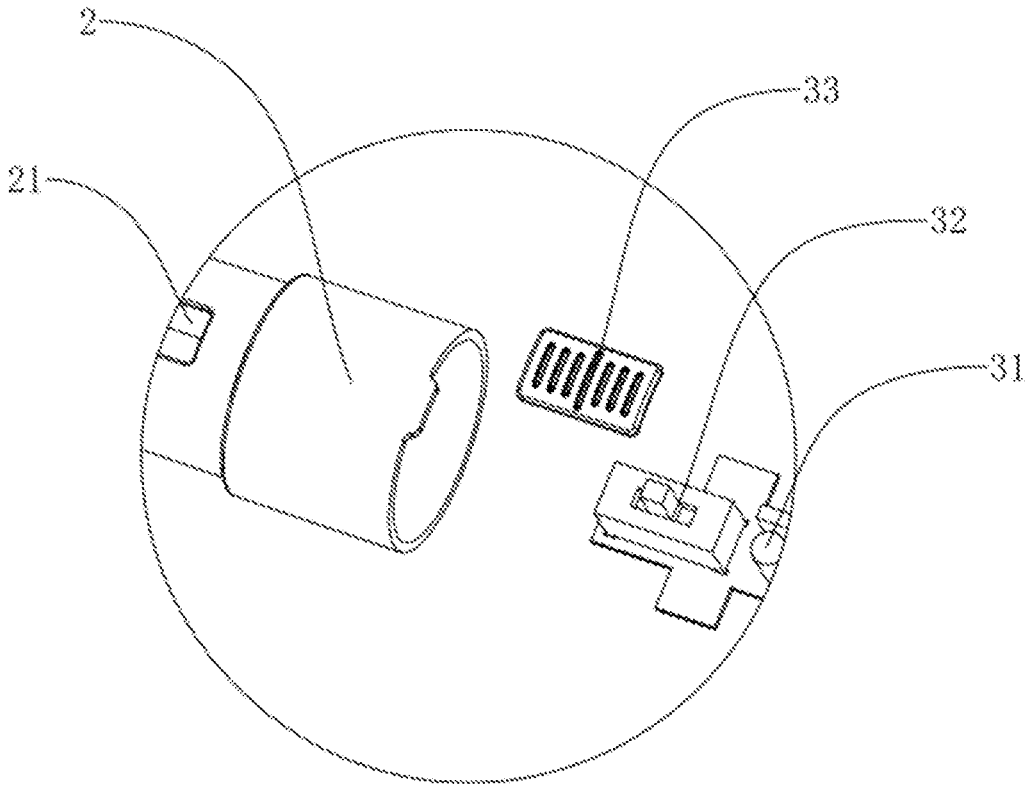
FIG. 3 is a schematic enlarged view of a portion A in FIG. 2.

As shown in FIGS. 1 to 3, the tube light body 1 includes a light tube, an LED light strip 4 having at least two different color temperatures and inserted in the light tube, and a driving power source 31 electrically connected with the LED light strip 4. The light tube is a glass light tube and is a T8 light tube. The driving power source 31 is a switching power source. The LED light strip 4 is fixed in the light tube, and the driving power source 31 is connected to the LED tube light body 5 by bolts, so as to realize a stable electrical connection between the driving power source 31 and the LED light strip 4. It should be noted that the LED tube light body 5 further includes at least one color adjustment switch 3 fixed on the terminal 2. The color adjustment switch 3 is configured to control the on and off of different color temperatures of the LED light strip 4. If there are N different color temperatures and N is greater than or equal to 2, (N+1)*N/2 different levels of color temperature modes can be obtained. Furthermore, according to the magnitude of the input current controlled by the driving power source 31, more than (N+1)*N/2 different levels of color temperature modes can be obtained.

Figure 4:
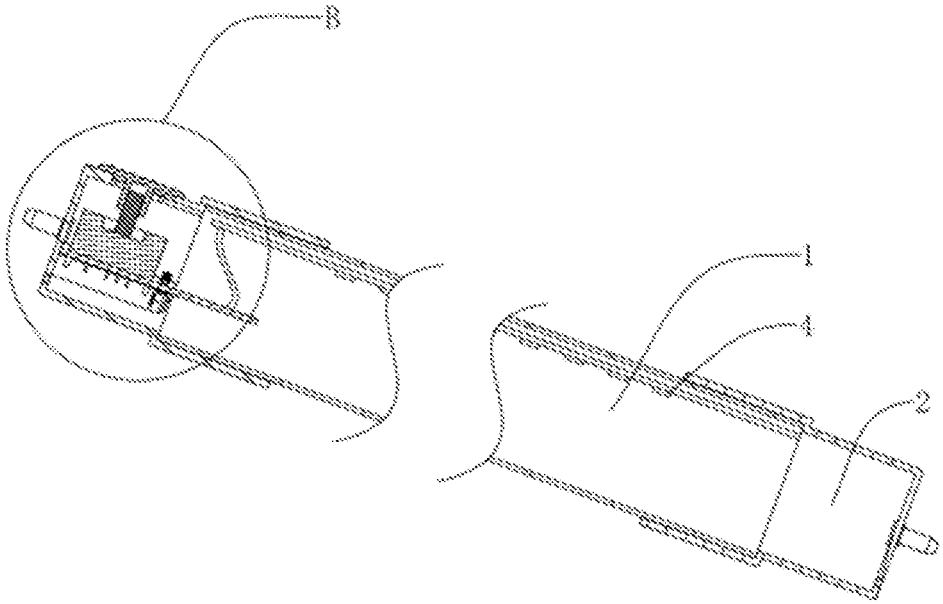
FIG. 4 is a schematic sectional view of the LED tube light body according to the present application.
Figure 5:
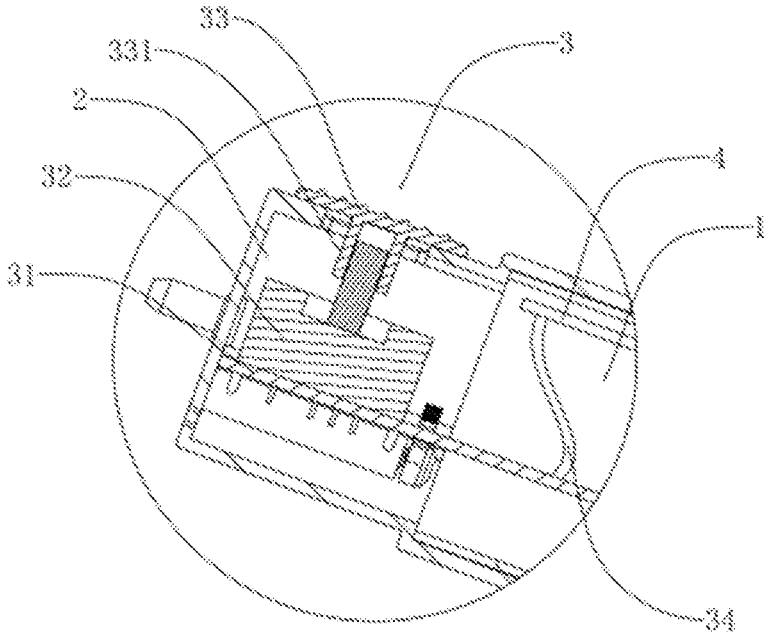
FIG. 5 is a schematic enlarged view of a portion B in FIG. 4.

As shown in FIGS. 3 to 5, the LED light strip 4 includes LED lamp beads with at least two different color temperatures, and an aluminum-based circuit board for connecting and fixing the LED lamp beads. The color adjustment switch 3 includes a shift switch 32 fixed on the driving power source 31. A switch panel 33 for driving the shift switch 32 is provided on the terminal 2. Connection wires 34 electrically connected with the LED light strip 4 are provided at one end of the driving power source 31. The terminal 2 is provided with a groove-shaped installation hole 21, and a lower end of the switch panel 33 is inserted into the installation hole 21 and connected to the shift switch 32. A cross section of the switch panel 33 along a width direction of the installation hole 21 is in the shape of $\pi$. Therefore, a lower side of the switch panel 33 that extends out of the installation hole 21 abuts against an outer side surface of a terminal, and buckle feet 331 abutting an inner side wall of the terminal 2 are provided on two sides of the switch panel 33 along the width direction of the installation hole 21, to achieve a stable connection between the switch panel 33 and the terminal. Multiple parallel ribs are arranged on an upper side of the switch panel 33. The ribs can increase the surface friction coefficient of the switch panel 33, thereby reducing the difficulty of moving the switch panel 33 and improving the surface aesthetics of the switch panel 33.

Second Embodiment

The difference between the second embodiment and the first embodiment is that the light tube in the second embodiment is a plastic light tube.

Third Embodiment

The difference between the third embodiment and the first embodiment is that the light tube in the third embodiment is a T5 light tube.

Forth Embodiment

The difference between the fourth embodiment and the first embodiment is that the driving power source 31 in the fourth embodiment is a linear power source.

Fifth Embodiment

The difference between the fifth embodiment and the first embodiment is that the LED light strip 4 in the fifth embodiment includes LED lamp beads with at least two different color temperatures and a flexible light board for connecting and fixing the LED lamp beads.

Sixth Embodiment

In the sixth embodiment, the LED light strip 4 has two different color temperatures, the different color temperatures are obtained by the 2700K lamp beads and the 6500K lamp beads forming the LED tube light, and three levels of color temperature modes are further obtained by turning on the two color temperatures separately or simultaneously, and more than four levels can be obtained through the control of the driving power source 31 in each color temperature mode, which facilitates the operation.

Seventh Embodiment

In the seventh embodiment, the LED light strip 4 has five different color temperatures, and (5+1)*5/2=15 levels of color temperature modes are obtained, and more than (5+1)*5/2=15 levels can be obtained through the control of the driving power source 31 in each color temperature mode, which has diversity and is easy to operate.

Seventh Embodiment

As shown in FIG. 6, a fixing member 332 for connecting and fixing the shift switch 32 is provided on a lower side of the switch panel 33. The fixing member 332 includes two fixing insertion pins, and the two fixing insertion pins are symmetrically arranged on two sides along a length direction of the installation hole 21.

Eighth Embodiment

Figure 7:
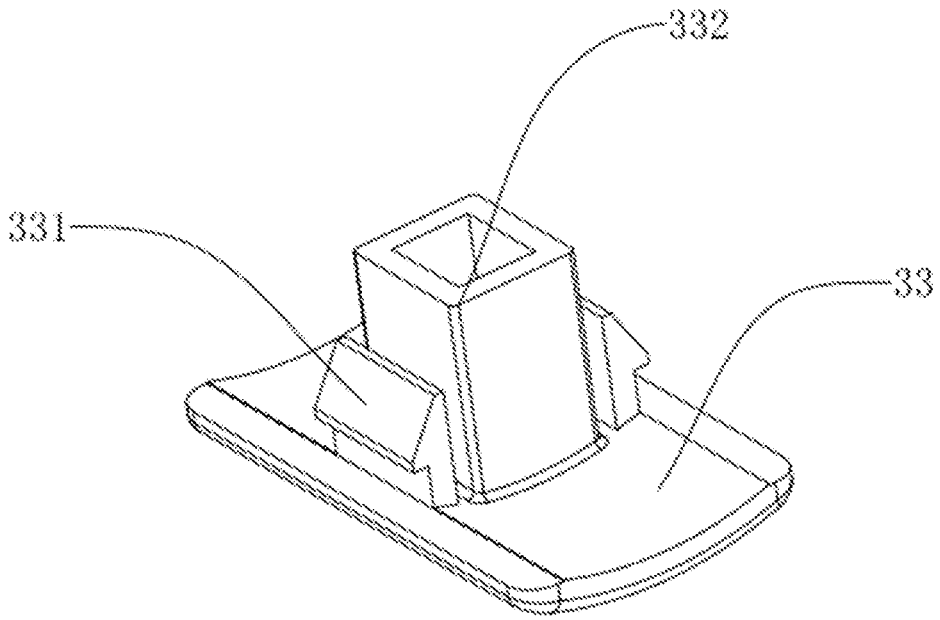
FIG. 7 is a schematic view showing a second structure of the switch panel according to the present application.
Figure 8:
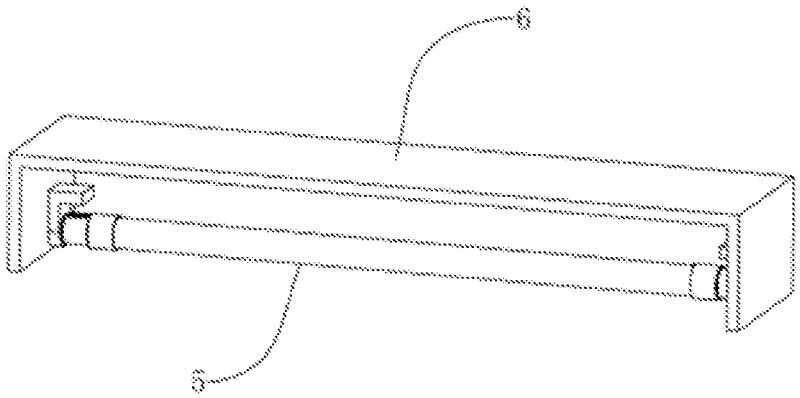
FIG. 8 is a schematic view showing a connection fixing structure for the LED tube light body and a mounting seat according to the present application.

As shown in FIG. 7, a fixing member 332 for connecting and fixing the shift switch 32 is provided on a lower side of the switch panel 33. The fixing member 332 includes a fixing insertion post, and an upper end of the shift switch 32 is inserted in the fixing insertion post.

In summary, according to the present application, through the modification of the LED tube light body 5, the modification for the mounting seat 6 or for the switch controlling the mounting seat 6 can be omitted, thereby saving time and efforts. The structure of the LED tube light according to the present application with a color adjustment switch has a simple structure, is easy to manufacture, and has good economic benefits.

Terms such as "first", "second", "third", "fourth" and the like (if exists) in the present application are used for distinguishing similar objects, and are not used for describing specific orders or sequences. It should be understood that the data used in this way are interchangeable under appropriate circumstances and the embodiments of the application described herein can be implemented in sequences other than those illustrated herein. In addition, the terms "include" and "have" and any variations thereof are intended to cover non-exclusive inclusions. For example, a process, a method, or a device that includes a series of steps or units is not limited to those clearly listed steps or units, and may instead include other steps or units not explicitly listed or inherent to the process, method, or device.

It should be noted that, the terms "first", "second" and the like are used only for description, and should not be construed as indicating or implying relative importance or implying the number of the indicated technical features. Thus, the features defined by "first", "second" and the like can explicitly or implicitly include at least one feature. In addition, the technical solutions between the various embodiments can be combined with each other, but must be on the basis that those technical solutions can be implemented by a person of ordinary skill in the art. If the combination of technical solutions conflicts or cannot be achieved, it should be considered that such a combination of technical solutions does not exist, and does not fall within the scope of protection claimed by the present application.

The principles and implementations of the present application are clarified with specific embodiments herein. The above description of the embodiments is only intended to assist understanding the method and the key concept of the present application. For those skilled in the art, modification can be made to the specific embodiments and the application scopes based on the concept of the present application, and in conclusion, the specification should not be construed as limitation to the present application.

The invention claimed is:

1. An LED tube light with a color adjustment switch, comprising an LED tube light body, the LED tube light body being provided with a tube light body and terminals arranged at two ends of the tube light body and configured to connect with a mounting seat, wherein the tube light body comprises a light tube, an LED light strip with at least two different color temperatures, and a driving power source electrically connected with the LED light strip, the LED tube light body further comprises at least one color adjustment switch fixed on the respective terminal, and the color adjustment switch is configured to control on and off of different color temperatures of the LED light strip, wherein the color adjustment switch comprises a shift switch fixed on the driving power source, a switch panel configured to drive the shift switch is provided on the terminal, and connection wires electrically connected with the LED light strip are provided at one end of the driving power source.

2. The LED tube light with the color adjustment switch according to claim 1, wherein the LED light strip comprises lamp beads with at least two different color temperatures, and an aluminum-based circuit board or a flexible light board for connecting and fixing the LED lamp beads.

3. The LED tube light with the color adjustment switch according to claim 2, wherein the LED light strip comprises 2700K lamp beads and 6500K lamp beads.

4. The LED tube light with the color adjustment switch according to claim 1, wherein the terminal is provided with a groove-shaped installation hole, and a lower end of the switch panel is inserted into the installation hole and connected to the shift switch, and buckle feet abutting an inner side wall of the terminal are provided on two sides of the switch panel along a width direction of the installation hole.

5. The LED tube light with the color adjustment switch according to claim 4, wherein a cross section of the switch panel along the width direction of the installation hole is in the shape of $\pi$.

6. The LED tube light with the color adjustment switch according to claim 1, wherein a plurality of parallel ribs is arranged on an upper side of the switch panel.

7. The LED tube light with the color adjustment switch according to claim 1, wherein the light tube is a glass light tube or a plastic light tube.

8. The LED tube light with the color adjustment switch according to claim 1, wherein the light tube is a T8 light tube or a T5 light tube.

9. The LED tube light with the color adjustment switch according to claim 1, wherein the driving power source is a switching power source or a linear power source.

* * * * *